US008559841B2

(12) United States Patent
Inukai

(10) Patent No.: US 8,559,841 B2
(45) Date of Patent: Oct. 15, 2013

(54) MULTIPLE-OUTPUT POWER SUPPLY UNIT INCLUDING VOLTAGE GENERATION CIRCUITS FOR APPLYING VOLTAGES TO LOADS AND IMAGE FORMING APPARATUS HAVING THE POWER SUPPLY UNIT

(75) Inventor: Katsumi Inukai, Iwakura (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 300 days.

(21) Appl. No.: 12/889,028

(22) Filed: Sep. 23, 2010

(65) Prior Publication Data

US 2011/0158675 A1 Jun. 30, 2011

(30) Foreign Application Priority Data

Dec. 28, 2009 (JP) ..... 2009-298333

(51) Int. Cl.
*G03G 15/00* (2006.01)

(52) U.S. Cl.
USPC ..... 399/88

(58) Field of Classification Search
USPC ..... 399/88
See application file for complete search history.

(56) References Cited

U.S. PATENT DOCUMENTS

| | | | |
|---|---|---|---|
| 4,962,307 | A | 10/1990 | Nakaya |
| 2003/0039495 | A1 | 2/2003 | Takami et al. |
| 2003/0185582 | A1 | 10/2003 | Inukai |

FOREIGN PATENT DOCUMENTS

| | | | |
|---|---|---|---|
| JP | 02-028670 | A | 1/1990 |
| JP | 09-134104 | | 5/1997 |
| JP | 09-244481 | A | 9/1997 |
| JP | 10-319808 | | 12/1998 |
| JP | 2001-013840 | A | 1/2001 |
| JP | 2003-066798 | | 3/2003 |
| JP | 2003-295718 | | 10/2003 |
| JP | 2004-348033 | | 12/2004 |

OTHER PUBLICATIONS

JP Office Action dtd Nov. 15, 2011, JP Appln. 2009-298333, English translation.

*Primary Examiner* — Quana M Grainger
(74) *Attorney, Agent, or Firm* — Banner & Witcoff, Ltd.

(57) ABSTRACT

A multiple-output power supply unit includes: a first voltage generation circuit that generates a first voltage applied to a first load; a first output terminal that outputs a second voltage corresponding to the first voltage to a second load; a first constant voltage element that is connected to the first output terminal; a second constant voltage element that is provided between the first constant voltage element and a ground; and a second output terminal that is connected between the first constant voltage element and the second constant voltage element so as to output a third voltage having a predetermined potential difference from the second voltage to a third load that is provided in a state of being electrically connected to the second load.

10 Claims, 5 Drawing Sheets

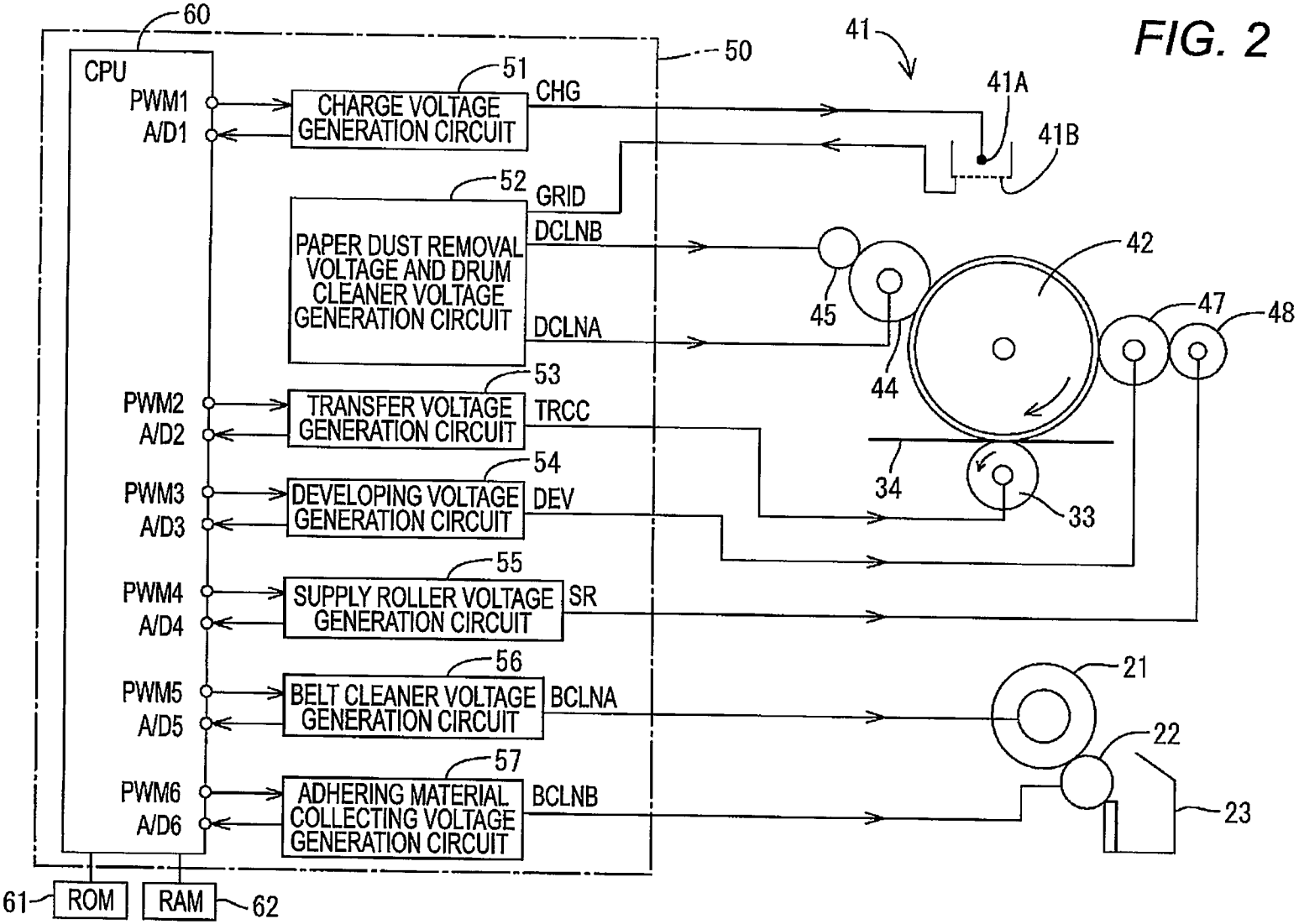
FIG. 2
41
41A
41B
42
47
48
23
22
21
33
34
44
45
50
CHG
GRID
DCLNB
DCLNA
TRCC
DEV
SR
BCLNA
BCLNB
51
52
53
54
55
56
57
CHARGE VOLTAGE GENERATION CIRCUIT
PAPER DUST REMOVAL VOLTAGE AND DRUM CLEANER VOLTAGE GENERATION CIRCUIT
TRANSFER VOLTAGE GENERATION CIRCUIT
DEVELOPING VOLTAGE GENERATION CIRCUIT
SUPPLY ROLLER VOLTAGE GENERATION CIRCUIT
BELT CLEANER VOLTAGE GENERATION CIRCUIT
ADHERING MATERIAL COLLECTING VOLTAGE GENERATION CIRCUIT
60
CPU
PWM1
A/D1
PWM2
A/D2
PWM3
A/D3
PWM4
A/D4
PWM5
A/D5
PWM6
A/D6
RAM
ROM
61
62

| | (V) |
|---|---|
| ZD1 ZENER VOLTAGE VZD1 (V) | 200 |
| ZD2 ZENER VOLTAGE VZD2 (V) | 500 |
| ZD3 ZENER VOLTAGE VZD3 (V) | 100 |
| DCLNB(V) | 700 |
| DCLNA(V) | 500 |
| GRID(V) | 800 |

MULTIPLE-OUTPUT POWER SUPPLY UNIT INCLUDING VOLTAGE GENERATION CIRCUITS FOR APPLYING VOLTAGES TO LOADS AND IMAGE FORMING APPARATUS HAVING THE POWER SUPPLY UNIT

CROSS REFERENCE TO RELATED APPLICATION

The present application claims priority from Japanese Patent Application No. 2009-298333, which was filed on Dec. 28, 2009, the disclosure of which is herein incorporated by reference in its entirety.

TECHNICAL FIELD

The apparatuses and devices consistent with the present invention relate to a multiple-output power supply unit and an image forming apparatus having the power supply unit, and more particularly, to a power supply technique for efficiently applying different voltages to a plurality of loads.

BACKGROUND

In the related art, a power supply technique for efficiently applying different voltages to a plurality of loads is disclosed. Specifically, the related art discloses a technique of applying different high voltages to a plurality of loads, which includes a cleaning roller (image carrying member cleaner) and a secondary roller (paper dust cleaner), using a grid voltage generated in the charger of an image forming apparatus.

SUMMARY

The related art technique can efficiently apply high voltages to loads such as a cleaning roller and a secondary roller without requiring a special-purpose high-voltage generation circuit for each of the desired voltages. However, in order to generate voltages applied to loads such as the cleaning roller and the secondary roller, a voltage generation circuit, a switching circuit, a voltage step-down circuit, and the like are required. In addition, the configuration of a power supply circuit is sometimes not simple. Therefore, there was a desire for a power supply unit with a simple configuration capable of applying predetermined voltages to a plurality of loads without requiring a special-purpose high-voltage generation circuit for each of the voltages.

The present invention aims to provide a multiple-output power supply unit capable of applying desired voltages to a plurality of loads with a simple circuit configuration.

According to an illustrative aspect of the present invention, there is provided a multiple-output power supply unit comprising: a first voltage generation circuit that generates a first voltage applied to a first load; a first output terminal that outputs a second voltage corresponding to the first voltage to a second load; a first constant voltage element that is connected to the first output terminal; a second constant voltage element that is provided between the first constant voltage element and a ground; and a second output terminal that is connected between the first constant voltage element and the second constant voltage element so as to output a third voltage having a predetermined potential difference from the second voltage to a third load that is provided in a state of being electrically connected to the second load.

BRIEF DESCRIPTION OF THE DRAWINGS

Illustrative aspects of the invention will be described in detail with reference to the following figures wherein:

FIG. 2 is a schematic block diagram of a high-voltage power supply unit of the printer;

DETAILED DESCRIPTION OF EXEMPLARY EMBODIMENTS OF THE PRESENT INVENTION

<First Embodiment>

A first embodiment of the present invention will be described with reference to FIGS. 1 to 5.

1. General Configuration of Printer

Figure 1:
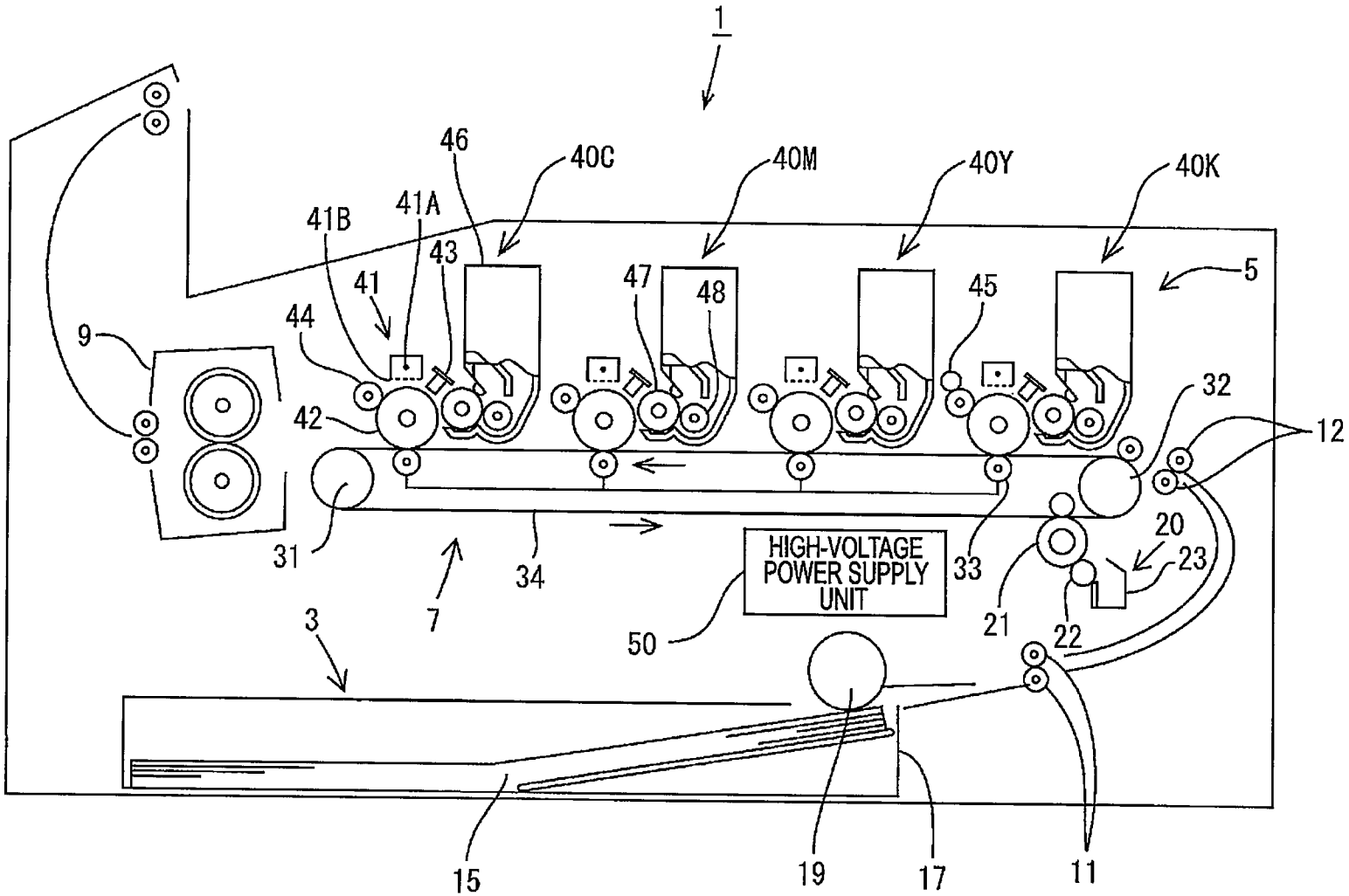
FIG. 1 is a schematic sectional diagram showing an inner configuration of a printer according to a first embodiment of the present invention.

FIG. 1 is a schematic sectional diagram showing an inner configuration of a color printer 1 (an example of an "image forming apparatus having a multiple-output power supply unit" of the present invention) of this embodiment. In the following description, when there is a need to distinguish constituent elements based on their colors, letters representing their colors such as Y (yellow), M (magenta), C (cyan), and K (black) are added to the end of the reference numerals of the respective constituent elements, but otherwise, such letters will not be added. It should be noted that the image forming apparatus is not limited to a color printer, but for example, may be a multi-function product having the functions of a FAX and a copier.

The color printer (hereinafter simply referred to as "printer") 1 includes a sheet feeding unit 3, an image forming portion 5, a transport mechanism 7, a fixing unit 9, a belt cleaning unit 20, and a high-voltage power supply unit 50. The printer 1 forms toner images made up of toner (developer) having one or plural colors (in this embodiment, the toner has four colors which are yellow, magenta, cyan, and black) on a sheet 15 (paper sheet, OHP sheet or such like) in accordance with image data input from an external device.

The sheet feeding unit 3 is provided at the lowermost part of the printer 1 and includes a tray 17 that stores sheets (an example of a recording medium) 15 and a pickup roller 19. The sheets 15 stored in the tray 17 are sent out by the pickup roller 19 one at a time and conveyed to the transport mechanism 7 by transport rollers 11 and registration rollers 12.

The transport mechanism 7 is a mechanism for transporting the sheets 15 and is detachably attached, for example, to a predetermined attachment portion (not shown) that is formed within the printer 1. The transport mechanism 7 includes a drive roller 31, a driven roller 32, and a belt 34. The belt 34 is stretched between the drive roller 31 and the driven roller 32. When the drive roller 31 rotates, the belt 34 moves in a direction in which a surface facing a photosensitive drum 42 moves from the right to the left in FIG. 1. In this way, the sheet 15, which is transported from the registration rollers 12, is transported to be positioned below the image forming portion 5. Moreover, the transport mechanism 7 includes four transfer rollers 33.

The image forming portion (an example of an "image forming unit") 5 includes four process units 40Y, 40M, 40C, and 40K and four exposure devices 43. Each process unit 40 includes a charger 41, a photosensitive drum (an example of an "image carrying member") 42, a drum cleaner roller (an example of an "image carrying member cleaner") 44, a paper dust removal roller (an example of a "paper dust cleaner") 45, a unit casing 46, a developing roller 47, and a supply roller 48. The respective process units 40Y, 40M, 40C, and 40K are detachably attached to a predetermined attachment portion (not shown) that is formed within the printer 1.

The photosensitive drum 42 is formed by forming a positively charged photosensitive layer on a base material made from aluminum, for example, and the aluminum base material is grounded to a ground line of the printer 1. The charger 41 is a scorotron-type charger, for example, and has a discharge wire 41A and a grid 41B. A charge voltage CHG is applied to the discharge wire 41A, and a grid voltage GRID of the grid 41B is controlled so that the surface of the photosensitive drum 42 is substantially at the same potential (for example, +800 V).

The exposure device 43 has a plurality of light-emitting elements (for example, LEDs) arranged in a line, for example, along the direction of the rotation axis of the photosensitive drum 42. The plurality of light-emitting elements are controlled to emit light in accordance with image data input from an external device, whereby electrostatic latent images are formed on the surface of the photosensitive drum 42. The exposure device 43 is installed in a fixed position inside the printer 1. The exposure device 43 may be one that uses a laser.

The unit casing 46 accommodates toner of each color (in this embodiment, positively charged nonmagnetic monocomponent toner is used, for example) and has the developing roller 47 and the supply roller 48. The developing roller 47 and the supply roller 48 are provided so as to face each other and are electrically connected to each other. The toner is supplied to the developing roller 47 by rotation of the supply roller 48 and frictionally charged with positive charges between the supply roller 48 and the developing roller 47. In addition, the developing roller 47 develops electrostatic latent images by supplying the toner onto the photosensitive drum 42 as a uniformly thin layer, whereby toner images are formed on the photosensitive drum 42.

The respective transfer rollers 33 are disposed at positions such that the belt 34 is interposed between the respective photosensitive drums 42 and the transfer roller 33. The respective transfer rollers 33 transfer the toner images formed on the photosensitive drums 42 to the sheet 15 in response to application of a transfer voltage TRCC which is applied between the transfer rollers 33 and the photosensitive drums 42 and which has a polarity (in this case, a negative polarity) opposite to the charged polarity of the toner. After that, the transport mechanism 7 transports the sheet 15 to the fixing unit 9 where the toner images are thermally fixed, and the sheet 15 is discharged to the top surface of the printer 1.

The drum cleaner roller 44 and the paper dust removal roller 45 constitute a drum cleaning mechanism that attracts and removes adhering material (mainly paper dust) on the photosensitive drum 42 by electrostatic force. The drum cleaner roller 44 and the paper dust removal roller 45 are provided so as to face each other and are electrically connected to each other. The drum cleaning mechanism mainly removes paper dust having a negative polarity during printing (during the passage of a sheet) or after a print job is completed and after a predetermined number of sheets are printed (during non-passage of sheet). In this example, it should be noted that the paper dust removal roller 45 is provided in only the process unit 40K. The paper dust is attracted from the photosensitive drum 42 to the paper dust removal roller 45 by the drum cleaner roller 44.

Moreover, the belt cleaning unit 20 is provided below the transport mechanism 7 and detachably attached to a predetermined attachment portion (not shown), for example. The belt cleaning unit 20 includes a belt cleaning roller 21, an adhering material collection roller 22, and a collecting box 23 and collects adhering material on the belt 34 (mainly, toner remaining on the belt 34). The belt cleaning roller 21 and the adhering material collection roller 22 are provided so as to face each other and are electrically connected to each other.

2. Configuration of High-Voltage Power Supply Unit

Next, an electrical configuration related to the present invention, of the printer 1 will be described with reference to FIG. 2. FIG. 2 is a schematic block diagram of the high-voltage power supply unit 50 mounted on a circuit board (not shown) and shows a connection configuration related to the high-voltage power supply unit 50. Although the high-voltage power supply unit 50 includes voltage generation circuits corresponding to the respective process units 40Y, 40M, 40C, and 40K, since the configurations corresponding to the respective process units are substantially the same, only the voltage generation circuit related to the process unit 40K is shown in FIG. 2.

The high-voltage power supply unit (an example of a "multiple-output power supply unit") 50 includes a CPU 60, a plurality of voltage generation circuits connected to the CPU 60, a ROM 61, and a RAM 62. The CPU 60 controls an overall operation of the printer 1 as well as the operations of the voltage generation circuits. The ROM 61 stores a program or the like for controlling an overall operation of the printer 1, and the RAM 62 stores image data or the like used for a printing process.

As shown in FIG. 2, the plurality of voltage generation circuits includes, for example, a charge voltage generation circuit 51, a paper dust removal voltage and drum cleaner voltage generation circuit 52, a transfer voltage generation circuit 53, a developing voltage generation circuit 54, a supply roller voltage generation circuit 55, a belt cleaner voltage generation circuit 56, and an adhering material collection voltage generation circuit 57. However, the configuration of the plurality of voltage generation circuits is not limited to this.

The charge voltage generation circuit (an example of a "first voltage generation circuit") 51 generates the charge voltage CHG applied to the discharge wire 41A of the charger (an example of a "first load") 41 and the grid voltage (an example of a "first voltage") GRID applied to the grid 41B of the charger 41. Here, the charge voltage CHG is 5.5 kV to 8 kV (positive polarity), for example, and the grid voltage GRID is about 800 V (positive polarity), for example. The grid voltage GRID is generated using a discharge resistance which appears during discharge between the discharge wire 41A and the grid 41B when the charge voltage CHG is applied to the charger 41.

For example, the charge voltage generation circuit 51 generates the charge voltage CHG in accordance with a PWM signal from a PWM1 port of the CPU 60, and the charge voltage CHG is feedback-controlled through an A/D1 port.

The paper dust removal voltage and drum cleaner voltage generation circuit 52 generates a paper dust removal voltage DCLNB applied to the paper dust removal roller 45 and a drum cleaner voltage DCLNA applied to the drum cleaner roller 44. Here, the paper dust removal voltage DCLNB is about 700 V, for example.

Moreover, the drum cleaner voltage DCLNA is about 500 V (positive polarity), for example. The paper dust removal voltage and drum cleaner voltage generation circuit 52 generates the paper dust removal voltage DCLNB and the drum cleaner voltage DCLNA based on the grid voltage GRID. The details of the charge voltage generation circuit 51 and the paper dust removal voltage and drum cleaner voltage generation circuit 52 will be described later.

The transfer voltage generation circuit 53 generates the transfer voltage TRCC applied to the transfer roller 33. Here, the transfer voltage TRCC is about −7 kV (negative polarity), for example. For example, the transfer voltage generation circuit 53 generates the transfer voltage TRCC in accordance with a PWM signal from a PWM2 port of the CPU 60, and the transfer voltage TRCC is feedback-controlled through an A/D2 port.

The developing voltage generation circuit 54 generates a developing voltage DEV applied to the developing roller 47. Here, the developing voltage DEV is about 300 to 550 V (positive polarity), for example. For example, the developing voltage generation circuit 54 generates the developing voltage DEV in accordance with a PWM signal from a PWM3 port of the CPU 60, and the developing voltage DEV is feedback-controlled through an A/D3 port.

The supply roller voltage generation circuit 55 generates a supply roller voltage SR applied to the supply roller 48. Here, the supply roller voltage SR is about 400 to 650 V (positive polarity), for example. For example, the supply roller voltage generation circuit 55 generates the supply roller voltage SR in accordance with a PWM signal from a PWM4 port from the CPU 60, and the supply roller voltage SR is feedback-controlled through an A/D4 port.

The belt cleaner voltage generation circuit 56 generates a belt cleaner voltage BCLNA applied to the belt cleaner roller 21. Here, the belt cleaner voltage BCLNA is about −1200 V (negative polarity), for example. For example, the belt cleaner voltage generation circuit 56 generates the belt cleaner voltage BCLNA in accordance with a PWM signal from a PWM5 port of the CPU 60, and the belt cleaner voltage BCLNA is feedback-controlled through an A/D5 port.

The adhering material collection voltage generation circuit 57 generates an adhering material collection voltage BCLNB applied to the adhering material collection roller 22. Here, the adhering material collection voltage BCLNB is about −1600 V (negative polarity), for example. For example, the adhering material collection voltage generation circuit 57 generates the adhering material collection voltage BCLNB in accordance with a PWM signal from a PWM6 port of the CPU 60, and the adhering material collection voltage BCLNB is feedback-controlled through an A/D6 port.

Figure 3:
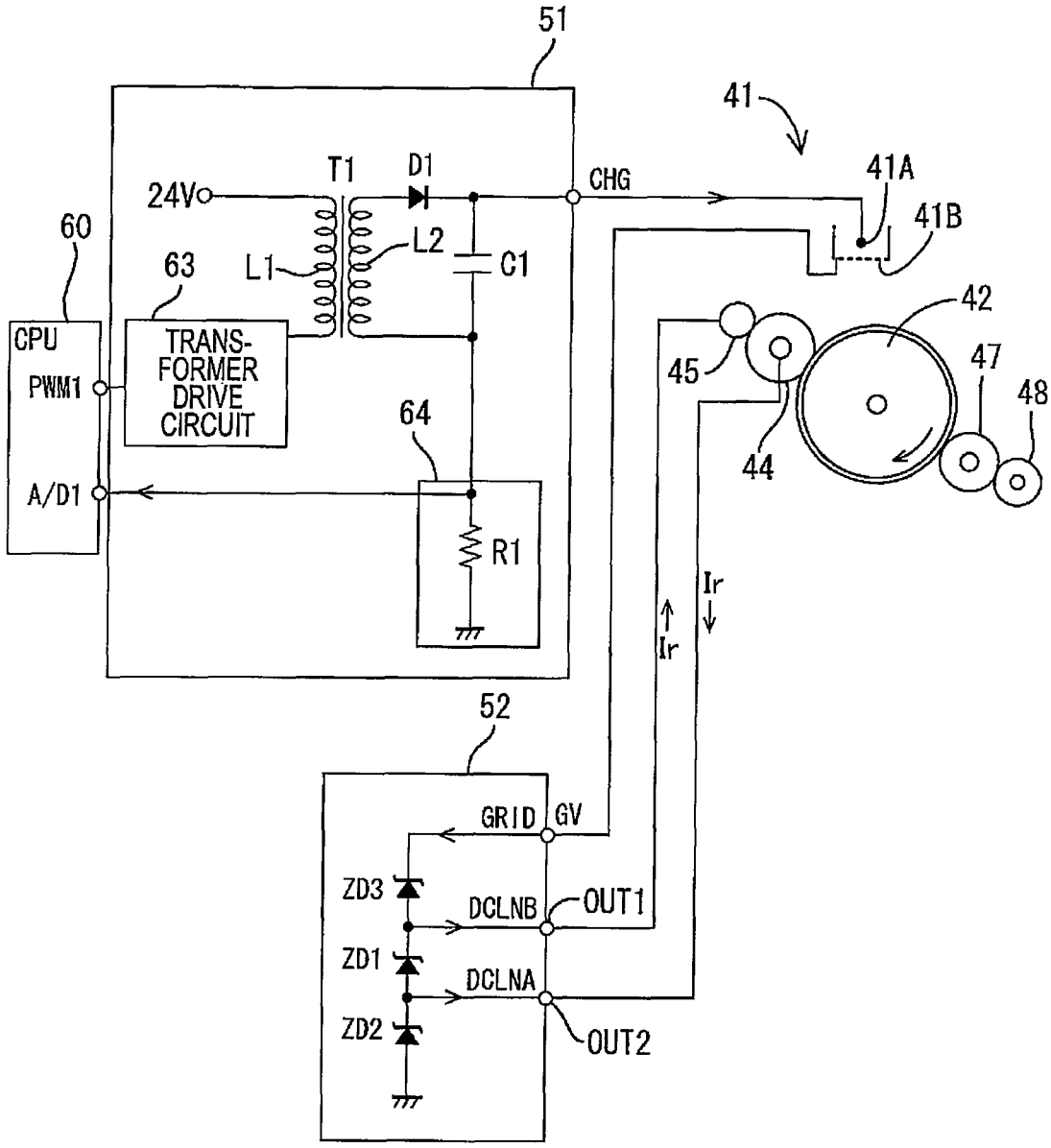
FIG. 3 is a schematic block diagram of a charge voltage generation circuit and a paper dust removal voltage and drum cleaner voltage generation circuit according to the first embodiment.
Figures 4, 5:
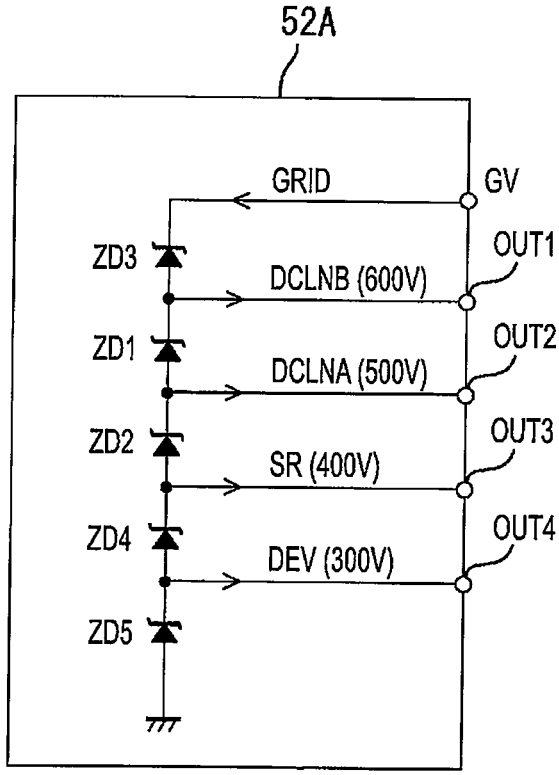
FIG. 4 is a table showing the relationship of various voltages in the first embodiment.
FIG. 5 is a schematic block diagram of another paper dust removal voltage and drum cleaner voltage generation circuit according to the first embodiment.

3. Configuration of Charge Voltage Generation circuit and Paper Dust Removal voltage and Drum Cleaner Voltage Generation Circuit Next, the charge voltage generation circuit 51 and the paper dust removal voltage and drum cleaner voltage generation circuit 52 will be described with reference to FIGS. 3 and 4. FIG. 3 is a schematic block diagram of the charge voltage generation circuit 51 and the paper dust removal voltage and drum cleaner voltage generation circuit 52, and FIG. 4 is a table showing examples of various voltages.

The charge voltage generation circuit 51 includes a transformer T1, a rectification diode D1, a smoothing capacitor C1, a transformer drive circuit 63, and a charge current detection circuit 64.

The transformer T1 includes a primary winding L1 and a secondary winding L2 and generates the charge voltage CHG at the secondary winding L2. The rectification diode D1 rectifies an alternating-current voltage generated in the secondary winding L2. The smoothing capacitor C1 smoothes the rectified alternating-current voltage to generate the charge voltage CHG which is a high direct-current voltage.

The transformer drive circuit 63 is connected to the primary winding L1 so as to drive the transformer T1. The transformer drive circuit 63 is controlled by the PWM signal from the PWM1 port of the CPU 60 so as to drive the primary winding L1.

The charge current detection circuit 64 includes a detection resistor R1 and detects a voltage by a charge current Ichg which flows when the charge voltage CHG is applied to the discharge wire 41A. The detected voltage is supplied to the A/D1 port of the CPU 60. The CPU 60 detects the charge current Ichg based on the voltage detected by the charge current detection circuit 64 and controls the charge voltage generation circuit 51 in a constant-current driving mode so that the charge current Ichg has a predetermined value. The charge current detection circuit 64 and the CPU 60 correspond to the charge current control circuit of the present invention.

Therefore, even when there is no configuration for detecting the grid voltage GRID as in the present embodiment, it is possible to allow the charger 41 to perform a desired operation by controlling the charge current Ichg with the charge current control circuit (60, 64). That is, it is possible to put the photosensitive drum 42 into a desired charged state.

On the other hand, the paper dust removal voltage and drum cleaner voltage generation circuit 52 includes a first output terminal OUT1, a second output terminal OUT2, a grid voltage terminal GV, and first to third Zener diodes ZD1, ZD2, and ZD3.

The grid voltage terminal GV receives the grid voltage GRID generated at the grid 41B in response to application of the charge voltage CHG to the discharge wire 41A. In the present embodiment, specifically, the charge voltage CHG is divided by the discharge resistance appearing during discharge between the discharge wire 41A and the grid 41B and the paper dust removal voltage and drum cleaner voltage generation circuit 52, whereby the grid voltage GRID is generated at the grid 41B. That is, in the present embodiment, the grid voltage GRID is generated by the charge voltage generation circuit 51 and the paper dust removal voltage and drum cleaner voltage generation circuit 52.

The first output terminal OUT1 outputs the paper dust removal voltage (an example of a "second voltage") DCLNB corresponding to the grid voltage GRID to the paper dust removal roller (an example of a "second load") 45.

The cathode of the first Zener diode (an example of a "first constant voltage element") ZD1 is connected to the first output terminal OUT1, and the anode of the first Zener diode ZD1 is connected to the cathode of the second Zener diode ZD2. The anode of the second Zener diode ZD2 is connected to the ground.

The second output terminal OUT2 is connected between the first Zener diode ZD1 and the second Zener diode ZD2. The second output terminal OUT2 outputs the drum cleaner voltage (an example of a "third voltage") DCLNA to the drum cleaner roller (an example of a "third load") 44 which is provided so as to be electrically connected to the paper dust removal roller 45. The drum cleaner voltage DCLNA has a predetermined potential difference (corresponding to a Zener voltage VZD1 of the first Zener diode ZD1) from the paper dust removal voltage DCLNB. Moreover, the second output terminal OUT2 receives a load current Ir which flows through the paper dust removal roller 45 and the drum cleaner roller 44 in response to the output of the paper dust removal voltage DCLNB and the drum cleaner voltage DCLNA.

The cathode of the third Zener diode ZD3 is electrically connected to the charge voltage generation circuit 51 through the grid voltage terminal GV and the charger 41. The grid voltage GRID is received at the anode of the third Zener diode ZD3. In other words, the grid voltage GRID is generated at the cathode of the third Zener diode ZD3 using the Zener voltages VZD1, VZD2, and VZD3. The anode of the third Zener diode ZD3 is connected to the cathode of the first Zener diode ZD1. That is, the first output terminal OUT1 is connected between the third Zener diode ZD3 and the first Zener diode ZD1. That is, the first to third Zener diodes ZD1, ZD2, and ZD3 are serially connected.

Here, it should be noted that the second and third loads are not limited to the paper dust removal roller 54 and the drum cleaner roller 44. For example, the second and third loads may be the supply roller 48 and the developing roller 47. In this case, the second and third voltages correspond to the supply roller voltage SR and the developing voltage DEV, respectively.

Moreover, as shown in a paper dust removal voltage and drum cleaner voltage generation circuit 52A of FIG. 5, fourth and fifth Zener diodes ZD4 and ZD5 may be serially connected to the first to third Zener diodes ZD1, ZD2, and ZD3. In this case, a paper dust removal voltage DCLNB (600 V), a drum cleaner voltage DCLNA (500 V), a supply roller voltage SR (400 V), and a developing voltage DEV (300 V) which are applied to four loads, for example, the paper dust removal roller 45, the drum cleaner roller 44, the supply roller 48, and the developing roller 47, respectively, may be generated from the grid voltage GRID and the respective voltages may be output to first to fourth output terminals OUT1, OUT2, OUT3, and OUT4.

4. Operation and Advantage of First Embodiment

According to the connection configuration of the first to third Zener diodes ZD1, ZD2, and ZD3, by appropriately selecting the Zener voltages VZD1, VZD2, and VZD3, it is possible to generate the paper dust removal voltage DCLNB and the drum cleaner voltage DCLNA from the grid voltage GRID (first voltage) with a simple configuration and output the voltages to the paper dust removal roller 45 and the drum cleaner roller 44.

That is, it is possible to apply desired voltages to the paper dust removal roller 45 and drum cleaner roller 44 (the second and third loads) different from the charger 41 (first load) with a simple circuit configuration without requiring a special-purpose high-voltage generation circuit. Moreover, by causing the load current Ir flowing through the paper dust removal roller 45 and the drum cleaner roller 44 to flow back to the second Zener diode ZD2, it is possible to suppress as far as possible a change in the grid voltage GRID with a change in the load current Ir. That is, since the current flowing through the second Zener diode ZD2 increases, the Zener voltage VZD2 of the second Zener diode ZD2 is stabilized, and the grid voltage GRID is stabilized.

For example, as shown in FIG. 4, the first, second, and third Zener diodes ZD1, ZD2, and ZD3 being used have Zener voltages VZD1, VZD2, and VZD3 which are 200 V, 500 V, and 100 V, respectively. By doing so, the paper dust removal voltage DCLNB of about 700 V and the drum cleaner voltage DCLNA of about 500 V are obtained as shown in FIG. 4.

At that time, the voltage difference between the paper dust removal voltage DCLNB and the drum cleaner voltage DCLNA becomes 200 V which corresponds to the Zener voltage VZD1 of the first Zener diode ZD1. That is, the paper dust removal voltage DCLNB is by 200 V higher than the drum cleaner voltage DCLNA. Therefore, the paper dust having the negative polarity is appropriately attracted to the paper dust removal roller 45 by the drum cleaner roller 44.

Moreover, it is possible to generate the paper dust removal voltage DCLNB having a different value from the grid voltage GRID in accordance with the value of the third Zener voltage VZD3 of the third Zener diode ZD3.

Furthermore, since the first to third constant voltage elements are constituted by the first to third Zener diodes ZD1, ZD2, and ZD3, the first to third constant voltage elements can be appropriately configured with a simple configuration.

<Second Embodiment>

Figure 6:
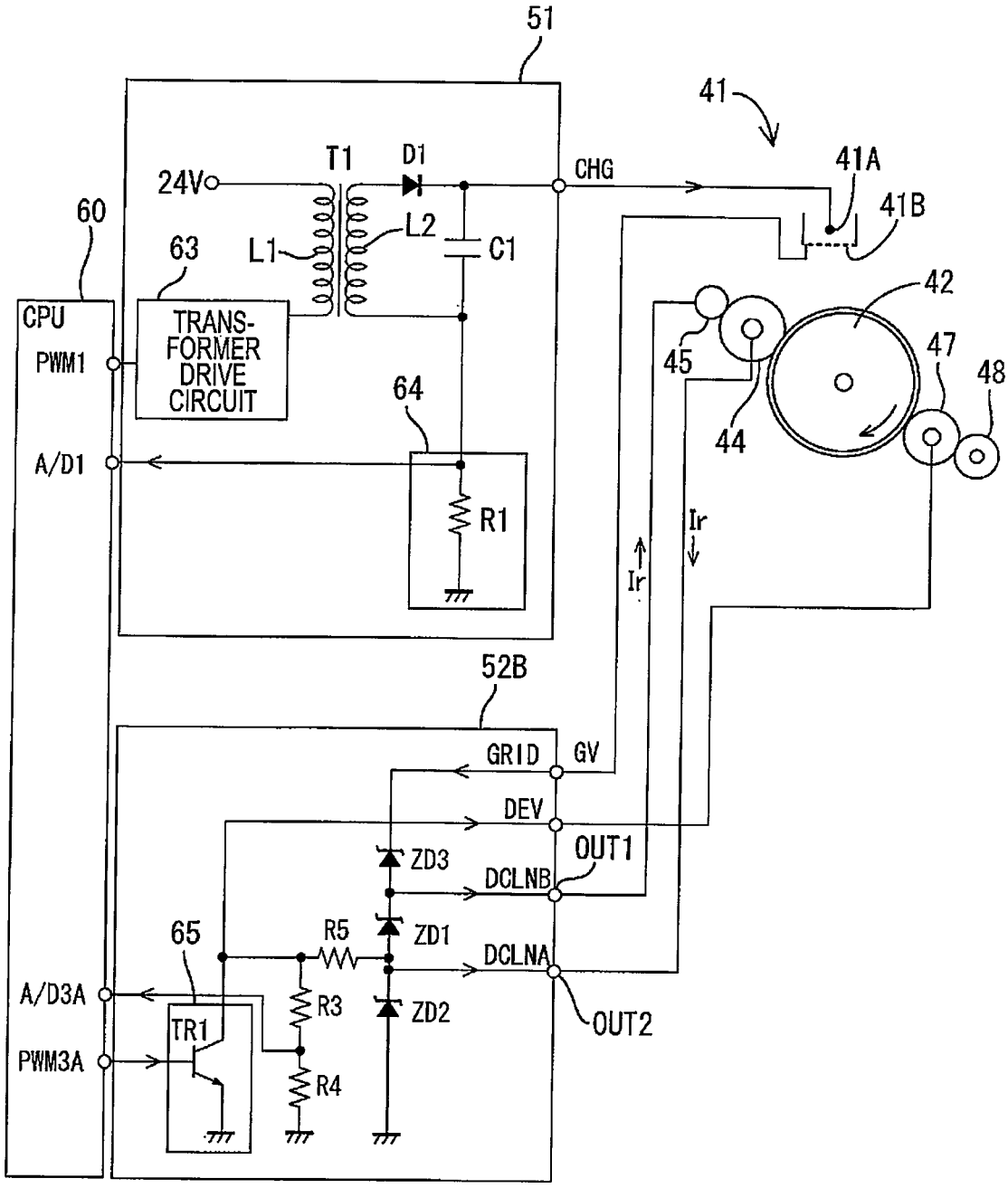
FIG. 6 is a schematic block diagram of a charge voltage generation circuit and a paper dust removal voltage and drum cleaner voltage generation circuit according to a second embodiment.

Next, a second embodiment of the present invention will be described with reference to FIG. 6. FIG. 6 is a schematic block diagram of a charge voltage generation circuit 51 and a paper dust removal voltage and drum cleaner voltage generation circuit 52B according to the second embodiment.

The first and second embodiments are partially different in the configuration of the paper dust removal voltage and drum cleaner voltage generation circuit. Specifically, the developing voltage DEV is generated by the paper dust removal voltage and drum cleaner voltage generation circuit 52B, and the developing voltage generation circuit 54 shown in FIG. 2 is omitted. Thus, the same constituent elements will be denoted by the same reference numerals, and only the different points will be described.

The paper dust removal voltage and drum cleaner voltage generation circuit 52B further includes a developing voltage generation circuit 65 (an example of a "second voltage generation circuit") as shown in FIG. 6. The developing voltage generation circuit 65 is connected to the second output terminal OUT2 so as to generate a developing voltage DEV (an example of a "fourth voltage") having a voltage value different from the paper dust removal voltage DCLNB and drum cleaner voltage DCLNA (the second and third voltages) in accordance with the drum cleaner voltage DCLNA (third voltage).

The developing voltage generation circuit 65 includes a transistor (an example of a "variable resistance unit") TR1 and a resistor R5. The transistor TR1 is provided between the resistor R5 and the ground. One end of the resistor R5 is connected to the second output terminal OUT2, and the other end of the resistor R5 is connected to the transistor TR1. That is, the developing voltage DEV is generated by dividing the drum cleaner voltage DCLNA by the resistor R5 and the ON resistance of the transistor TR1.

The developing voltage generation circuit 65 further includes a developing voltage detection circuit (R3, R4) which is provided between the other end of the resistor R5 and the ground. The developing voltage detection circuit (R3, R4) is constituted, for example, by voltage-dividing resistors R3 and R4, and the detected divided voltage value is supplied to an A/D3A port of the CPU 60. The CPU 60 generates a PWM signal for controlling the ON resistance of the transistor TR1 based on the detected value of the developing voltage DEV and supplies the PWM signal from the PWM3A port to the developing voltage generation circuit 65. By controlling the ON resistance of the transistor TR1, the value of the developing voltage DEV is controlled.

5. Advantage of Second Embodiment

According to the configuration of the second embodiment, the developing voltage generation circuit 65 (second voltage generation circuit) is connected to the second output terminal OUT2 where a high volume of circuit current flows. Therefore, it is possible to secure current necessary for the transistor TR1 to control the ON resistance of the transistor TR1. As a result, it is possible not only to improve the precision of the developing voltage generation circuit 65 but also to suppress a change in the grid voltage GRID.

For example, in the case of voltage configuration shown in FIG. 4, by dividing the drum cleaner voltage DCLNA of 500 V with the resistor R5 and the ON resistance of the transistor TR1, it is possible to generate the developing voltage DEV of 400 V, for example, with a simple configuration.

<Other Embodiments>

The present invention is not limited to the embodiments described above and illustrated in the drawings, and for example, the following embodiments are also included in the technical scope of the present invention.

(1) Although the above-described embodiments have described an example where the second constant voltage element is configured by only one second Zener diode ZD2, the present invention is not limited to this. The second constant voltage element may be configured by a plurality of second Zener diodes ZD2 connected in series. In this case, the degree of freedom of setting the drum cleaner voltage DCLNA (third voltage) is increased, and for example, the drum cleaner voltage can be set to a higher voltage.

(2) Although the above-described embodiments have described an example where Zener diodes are used as the first to third constant voltage elements, the present invention is not limited to this. For example, a varistor may be used as the constant voltage element, and a configuration that uses the ON resistance of a transistor may be used.

(3) In the above-described embodiments, the third Zener diode ZD3 (third constant voltage element) may be omitted. In this case, the paper dust removal voltage DCLNB (second voltage) is equal to the grid voltage GRID (first voltage).

(4) Although the above-described embodiments have described an example where the grid voltage GRID which is a positive voltage is used as the first voltage, the present invention is not limited to this. For example, the adhering material collection voltage BCLNB which is a negative voltage may be used as the first voltage, and the paper dust removal voltage DCLNB and the drum cleaner voltage DCLNA having the negative polarity may be generated using the adhering material collection voltage BCLNB. Alternatively, the transfer voltage TRCC which is a negative voltage may be used as the first voltage, and the belt cleaner voltage BCLNA and the adhering material collection voltage BCLNB having the negative polarity may be generated using the transfer voltage TRCC. When a negative voltage is used as the first voltage, and the Zener diodes are used as the respective constant voltage elements, the connection directions of the Zener diodes may be reversed from those in the above-described embodiments.

(5) The multiple-output power supply unit according to the present invention can be applied to all apparatuses which require a plurality of output voltages without being limited to an image forming apparatus.

According to the first aspect of the exemplary embodiments, there is provided a multiple-output power supply unit comprising: a first voltage generation circuit that generates a first voltage applied to a first load; a first output terminal that outputs a second voltage corresponding to the first voltage to a second load; a first constant voltage element that is connected to the first output terminal; a second constant voltage element that is provided between the first constant voltage element and a ground; and a second output terminal that is connected between the first constant voltage element and the second constant voltage element so as to output a third voltage having a predetermined potential difference from the second voltage to a third load that is provided in a state of being electrically connected to the second load.

According to the connection configuration of the first and second constant voltage elements of this configuration, by using a Zener diode as the first and second constant voltage elements, for example, it is possible to generate the second and third voltages from the first voltage with a simple configuration and output the second and third voltages to the second and third loads. That is, it is possible to apply desired voltages to loads different from the first load with a simple circuit configuration without requiring a complicated special-purpose voltage generation circuit. Moreover, by causing a load current flowing through the second and third loads to flow back to a voltage-dividing circuit of the first voltage, which is constituted by the first and second constant voltage elements, through the second output terminal, it is possible to suppress as far as possible a change in the first voltage with a change in the load current of the second and third loads. Here, it should be noted that generation of the first voltage by the first voltage generation circuit is not limited to the case where the first voltage is generated by only the first voltage generation circuit.

According to the second aspect of the exemplary embodiments, in addition to the first aspect, wherein the first constant voltage element is a first Zener diode, and the second constant voltage element is a second Zener diode, wherein a cathode of the first Zener diode is connected to the first output terminal, and an anode of the first Zener diode is connected to a cathode of the second Zener diode, and wherein an anode of the second Zener diode is connected to the ground.

According to this configuration, since the first and second constant voltage elements are configured by the Zener diodes, the multiple-output power supply unit can be appropriately configured with a simple configuration.

According to the third aspect of the exemplary embodiments, in addition to the first aspect or the second aspect, the multiple-output power supply unit further comprises, a third constant voltage element that receives the first voltage, wherein the first output terminal is connected between the third constant voltage element and the first constant voltage element.

According to this configuration, it is possible to generate the second voltage having a different value from the first voltage in accordance with a constant voltage value of the third constant voltage element.

According to the fourth aspect of the exemplary embodiments, in addition to the third aspect, wherein the third constant voltage element is a third Zener diode, a cathode of the third Zener diode being electrically connected to the first voltage generation circuit, and an anode of the third Zener diode being connected to the cathode of the first Zener diode.

According to this configuration, it is possible to appropriately configure the third constant voltage element with a simple configuration.

According to the fifth aspect of the exemplary embodiments, in addition to any one of the first aspect to the fourth aspect, the multiple-output power supply unit further comprises, a second voltage generation circuit that is connected to the second output terminal so as to generate a fourth voltage having a voltage value different from the second and third voltages in accordance with the third voltage.

According to this configuration, since the second voltage generation circuit is connected to a location where a high volume of the circuit current flows, it is possible not only to improve the precision of the second voltage generation circuit but also to suppress a change in the first voltage.

According to the sixth aspect of the exemplary embodiments, in addition to the fifth aspect, wherein the second voltage generation circuit includes a variable resistance unit and a resistor, wherein the variable resistance unit is provided between the resistor and the ground, and wherein one end of the resistor is connected to the second output terminal, and the other end of the resistor is connected to the variable resistance unit.

According to the seventh aspect of the exemplary embodiments, in addition to anyone of the first aspect to the sixth aspect, wherein the multiple-output power supply unit is provided in an image forming apparatus, and wherein the first load, the second load and third load are loads provided in the image forming apparatus.

According to this configuration, it is possible to apply desired voltages to a plurality of loads of an image forming apparatus with a simple circuit configuration. Therefore, it is possible to achieve weight reduction and energy reduction in the image forming apparatus.

According to the eighth aspect of the exemplary embodiments, in addition to the seventh aspect, wherein the image forming apparatus includes a charger having a discharge wire and a grid, wherein the first voltage generation circuit is a charge voltage generation circuit that generates a charge voltage applied to the discharge wire, wherein the first voltage is a grid voltage that is generated at the grid when the charge voltage is applied to the discharge wire, wherein the multiple-output power supply unit further includes a grid voltage terminal that receives the grid voltage, and wherein the first output terminal outputs a second voltage corresponding to the grid voltage to the second load of the image forming apparatus.

According to this configuration, by using a Zener diode as the first and second constant voltage elements, for example, it is possible to generate with a simple configuration the first and second voltages from the grid voltage and output the first and second voltages to two loads of the image forming apparatus. That is, it is possible to apply the desired voltages to loads in the image forming apparatus with a simple circuit configuration without requiring a special-purpose high-voltage generation circuit. Moreover, it is possible to suppress as far as possible a change in the first voltage with a change in the load current.

According to the ninth aspect of the exemplary embodiments, in addition to the eighth aspect, wherein the second load is a paper dust cleaner, and the third load is a image carrying member cleaner, and wherein the second voltage is a paper dust cleaner voltage applied to the paper dust cleaner, and the third voltage is an image carrying member cleaner voltage applied to the image carrying member cleaner.

According to this configuration, it is possible to generate with a simple configuration the paper dust cleaner voltage and the image carrying member cleaner voltage from the grid voltage without requiring a special-purpose high-voltage generation circuit.

According to the tenth aspect of the exemplary embodiments, in addition to the eighth aspect or the ninth aspect, the multiple-output power supply unit further comprises, a charge current control circuit that detects and controls a charge current that flows in response to application of the charge voltage to the discharge wire.

According to this configuration, even when there is no configuration for detecting the grid voltage, it is possible to allow a charger to perform a desired operation by controlling the charge current. That is, it is possible to put the image carrying member of the image forming apparatus into a desired charged state.

According to the eleventh aspect of the exemplary embodiments, there is provided an image forming apparatus comprising: an image carrying member that carries developer; a charger having a discharge wire and a grid, and charging the image carrying member; the multiple-output power supply unit according to anyone of the first aspect to the tenth aspect; a second load to which the second voltage is applied; and a third load that is provided so as to face the second load, and to which the third voltage is applied.

According to this configuration, for example, it is possible to generate a paper dust cleaner voltage (second voltage) applied to a paper dust cleaner serving as the second load and an image carrying member cleaner voltage (third voltage) applied to an image carrying member cleaner serving as the third load with a simple configuration from the grid voltage. As a result, it is possible to suppress as far as possible a change in the grid voltage with a change in the load current.

According to the multiple-output power supply unit of the present invention, it is possible to apply desired voltages to a plurality of loads with a simple circuit configuration.

What is claimed is:

1. A multiple-output power supply unit comprising:

a first voltage generation circuit that generates a first voltage applied to a first load;

a first output terminal that outputs a second voltage corresponding to the first voltage to a second load;

a first constant voltage element that is connected to the first output terminal;

a second constant voltage element that is provided between the first constant voltage element and a ground;

a second output terminal that is connected between the first constant voltage element and the second constant voltage element so as to output a third voltage having a predetermined potential difference from the second voltage to a third load that is provided in a state of being electrically connected to the second load; and a second voltage generation circuit that is connected to the second output terminal so as to generate a fourth voltage having a voltage value different from the second and third voltages in accordance with the third voltage.

2. The multiple-output power supply unit according to claim 1, wherein the first constant voltage element is a first Zener diode, and the second constant voltage element is a second Zener diode, wherein a cathode of the first Zener diode is connected to the first output terminal, and an anode of the first Zener diode is connected to a cathode of the second Zener diode, and wherein an anode of the second Zener diode is connected to the ground.

3. The multiple-output power supply unit according to claim 2, further comprising, a third constant voltage element that receives the first voltage, wherein the first output terminal is connected between the third constant voltage element and the first constant voltage element.

4. The multiple-output power supply unit according to claim 3, wherein the third constant voltage element is a third Zener diode, a cathode of the third Zener diode being electrically connected to the first voltage generation circuit, and an anode of the third Zener diode being connected to the cathode of the first Zener diode.

5. The multiple-output power supply unit according to claim 1, wherein the second voltage generation circuit includes a variable resistance unit and a resistor, wherein the variable resistance unit is provided between the resistor and the ground, and wherein one end of the resistor is connected to the second output terminal, and the other end of the resistor is connected to the variable resistance unit.

6. The multiple-output power supply unit according to claim 1, wherein the multiple-output power supply unit is provided in an image forming apparatus, and wherein the first load, the second load and third load are loads provided in the image forming apparatus.

7. The multiple-output power supply unit according to claim 6, wherein the image forming apparatus includes a charger having a discharge wire and a grid, wherein the first voltage generation circuit is a charge voltage generation circuit that generates a charge voltage applied to the discharge wire, wherein the first voltage is a grid voltage that is generated at the grid when the charge voltage is applied to the discharge wire, wherein the multiple-output power supply unit further includes a grid voltage terminal that receives the grid voltage, and wherein the first output terminal outputs a second voltage corresponding to the grid voltage to the second load of the image forming apparatus.

8. The multiple-output power supply unit according to claim 7, wherein the second load is a paper dust cleaner, and the third load is an image carrying member cleaner, and wherein the second voltage is a paper dust cleaner voltage applied to the paper dust cleaner, and the third voltage is an image carrying member cleaner voltage applied to the image carrying member cleaner.

9. The multiple-output power supply unit according to claim 7, further comprising, a charge current control circuit that detects and controls a charge current that flows in response to application of the charge voltage to the discharge wire.

10. An image forming apparatus comprising:

an image carrying member that carries developer;

a charger having a discharge wire and a grid, and charging the image carrying member;

the multiple-output power supply unit according to claim 1;

the second load to which the second voltage is applied; and the third load that is provided so as to face the second load, and to which the third voltage is applied.

* * * * *